United States Patent [19]

Faulkner et al.

[11] 4,431,943

[45] Feb. 14, 1984

[54] ELECTRON DISCHARGE DEVICE HAVING A HIGH SPEED CAGE

[75] Inventors: Richard D. Faulkner; Robert E. McHose, both of Lancaster, Pa.

[73] Assignee: RCA Corporation, New York, N.Y.

[21] Appl. No.: 311,279

[22] Filed: Oct. 14, 1981

Related U.S. Application Data

[63] Continuation-in-part of Ser. No. 216,907, Dec. 16, 1980, abandoned.

[51] Int. Cl.[3] ..... H01J 40/00

[52] U.S. Cl. ..... 313/533; 313/541

[58] Field of Search ..... 313/532, 533, 534, 535, 313/536, 537, 538, 539, 540, 541, 542, 103 R, 103 CM, 104, 105 R, 105 CM

[56] References Cited

U.S. PATENT DOCUMENTS

| | | | |
|---|---|---|---|
| 2,868,994 | 1/1959 | Anderson | 313/536 |
| 2,908,840 | 10/1959 | Anderson | 313/536 |
| 3,099,764 | 7/1963 | McDonie et al. | 313/536 |
| 3,109,957 | 11/1963 | McGee et al. | 313/536 |
| 3,753,023 | 8/1973 | Sommer | 313/536 |

*Primary Examiner*—David K. Moore
*Assistant Examiner*—Robert E. Wise
*Attorney, Agent, or Firm*—Eugene M. Whitacre; Dennis H. Irlbeck; Vincent J. Coughlin, Jr.

[57] ABSTRACT

A photomultiplier tube comprises an evacuated envelope having therein a photocathode, an anode and a high speed electron multiplier. The electron multiplier includes a primary dynode having a substantially parallel electron permeable member spaced from the primary dynode and disposed between the photocathode and the primary dynode. The electron permeable member also extends between the primary dynode and a plurality of secondary dynodes and accelerates secondary electrons from the primary dynode towards an input secondary dynode. Steering means disposed between the electron permeable member and the secondary dynodes direct the secondary electrons toward the input secondary dynode. Optional electron permeable second members, spaced from and disposed parallel to the secondary dynodes are operated at a potential midway between the adjacent dynode and the next succeeding dynode to accelerate the secondary electrons towards the anode.

7 Claims, 3 Drawing Figures

ELECTRON DISCHARGE DEVICE HAVING A HIGH SPEED CAGE

This is a continuation-in-part of application Ser. No. 216,907 filed Dec. 16, 1980, now abandoned.

BACKGROUND OF THE INVENTION

The present invention relates to electron discharge devices and particularly to a high speed cage for an electron multiplier.

An electron multiplier is a device utilizing secondary electron emission to amplify or multiply the electron current from a primary electron source, such as a photocathode or a thermionic cathode. The usual electron multiplier comprises a series or chain of secondary emitting elements, called dynodes, interposed between a primary electron source and an output collector or anode. The electrodes are constructed and arranged to form an electron optical system for directing primary electrons from the primary source onto the first dynode, releasing therefrom several secondary electrons for each primary electron. These secondaries are directed by the electron optical system onto the next dynode where each produces more secondaries. This process is repeated at each succeeding dynode or "stage" of the multiplier, thus producing a greatly multiplied electronic current from the final dynode to the collector. The number of dynodes or stages may be from one to twenty or more depending on the amount of amplification needed. Each succeeding dynode in the chain is maintained at a potential substantially higher, e.g., 100 volts, than the preceding dynode, to accelerate the secondaries from element to element and the dynodes are preferably shaped to direct and focus the electrons emitted thereby to the next dynode.

Electron multipliers are particularly useful for amplifying electron currents produced by weak signals, such as light or nuclear radiation. When used for detecting and/or counting rapidly recurrent signals such as nuclear particles, it is necessary that the multiplier have sufficient speed and a resolving time low enough to distinguish between successive signals or particles.

The speed of a multiplier can be increased by reducing the overall transit time of primary and secondary electrons between the primary source and the collector. The resolving time of a multiplier is limited by the transit time spread of electrons through the multiplier chain, that is, the difference between the transit times of the fastest and slowest electrons. This transit time spread is primarily due to differences in the trajectories taken by various electrons through the multiplier and differences in the initial velocities of secondary electrons.

In photomultiplier tubes, the speed or transit time of the tube is a function of both the photocathode transit time difference and the transit time of the electron multiplier. The photocathode transit time difference, defined as the time difference between peak current outputs for simultaneous small-spot illumination of different parts of the photocathode, is longer for edge illumination than for center illumination because of the longer edge trajectories and the weaker electric field near the edge of the photocathode. In a planar photocathode, the center-to-edge transit time difference may be as much as 10 nanoseconds; whereas for sphericalsection photocathodes, such as that shown in FIG. 1, the transit time response is more uniform because the electron paths are nearly equal in length.

The photocathode transit time difference is ultimately limited by the initial velocity distribution and angular distribution of the photoelectrons. These distributions cause time broadening of the electron packet during its flight from the photocathode to the first dynode. The broadening effect can be minimized by increasing the strength of the electric field at the surface of the photocathode.

Since the energy spread of secondary electrons is even larger than that of photoelectrons, the initial velocity distribution of the photoelectrons is one of the major limitations of the time response of the electron multiplier. Among the expedients used to improve the time response of the electron multiplier are the use of high electric field strengths at the dynode surfaces and compensated dynode design geometries.

A portion of a compensated design multiplier is shown in the prior art structure of FIG. 2. In a compensated design multiplier longer electron paths and weaker electric fields alternate with shorter electron paths and stronger fields from dynode to dynode to produce nearly equal total transit time for the secondary electrons.

U.S. Pat. No. 2,200,722 to Pierce et al., issued on May 14, 1940 and U.S. Pat. No. 2,245,624 to Teal, issued June 17, 1941 are representative of structures utilizing centrally disposed auxiliary electrodes between the rows of dynodes for producing strong electric fields to accelerate and converge the secondary electrons from one dynode in the multiplier to the succeeding dynode. The auxiliary electrodes are disclosed to be linear rods or wires which are operated at potentials higher than either of the dynodes bracketing the auxiliary electrode.

U.S. Pat. No. 2,868,994 to Anderson, issued on Jan. 13, 1959 and U.S. Pat. No. 2,903,595 to Morton, issued on Sept. 8, 1959 disclose electron multipliers having high voltage accelerating and focusing electrodes which operate at potentials several hundred to several thousand volts more positive than the potentials on the adjacent dynodes. In an embodiment shown in FIG. 1 of the Morton patent, a high voltage apertured accelerating electrode 15 comprises grids or otherwise apertured portions 17 connected together at their ends to form a single zig-zag member that extends along the medial plane between the two rows of dynodes.

The high voltage focusing and accelerating electrode structures described above reduce the secondary electron transit time through the electron multiplier; however, such electrodes frequently generate extraneous noise because of the great potential difference between the electrodes and the adjacent dynodes.

SUMMARY OF THE INVENTION

An electron discharge device includes a source of primary electrons, an anode and an electron multiplier disposed between the source of electrons and the anode. The electron multiplier comprises a primary dynode having a secondary emissive surface for propagating secondary electrons therefrom in response to primary electrons from the source impinging thereon. At least one secondary dynode is spaced from the primary dynode for continuing the propagation of the secondary electrons toward the anode. An electron permeable member is disposed between the source and the primary dynode. The electron permeable member also extends between the primary dynode and the secondary dynode. Steering means is disposed between the electron permeable member and the secondary dynode for directing the secondary electrons from the primary dynode toward the secondary dynode.

DETAILED DESCRIPTION OF THE PREFERRED EMBODIMENT

Figure 1:
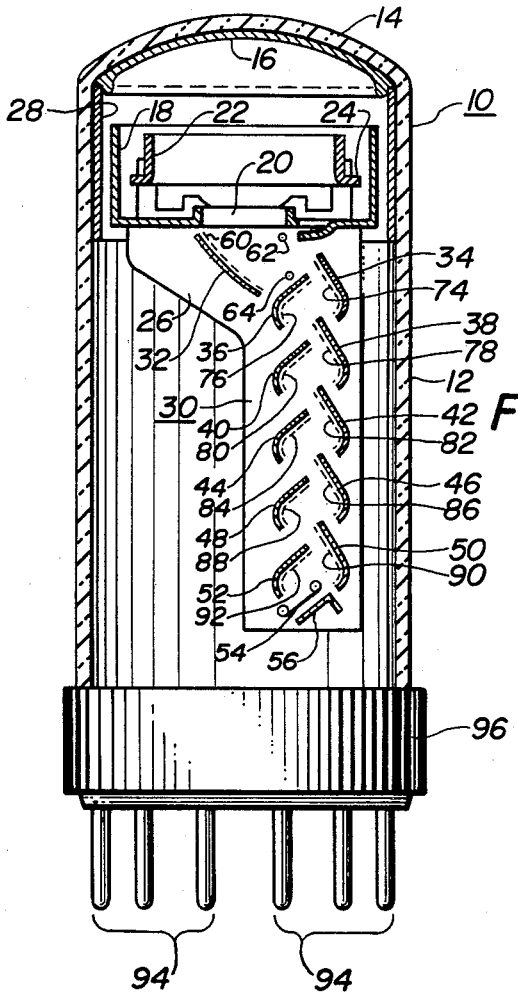
FIG. 1 is a plan view in axial section of a photomultiplier tube in which the present invention is incorporated.

The tube shown in FIG. 1 comprises an evacuated envelope 10, having a cylindrical sidewall 12. The envelope 10 is closed at one end by a transparent faceplate 14, which extends substantially transversely of the longitudinal axis of the tube. A stem portion (not shown) closes the other end of the envelope 10. A photoemissive cathode 16 is formed on the interior surface of the faceplate 14. The photoemissive cathode 16 may comprise any of the known materials such as, for example, potassium-sodium-antimony or a multialkali photoemissive surface. The photocathode 16 provides photoelectrons in response to radiation incident thereon.

The tube is provided with a cup-shaped field forming electrode 18, which is spaced from the photocathode 16 and which terminates in a substantially flat base portion having an aperture 20 therein. Spaced inside the field forming electrode 18 is a focus electrode 22 which is a hollow tubular member having a radially extending outwardly directed bottom support flange 24 integral therewith. The field forming electrode 18 and the focus electrode 22 are electrically insulated from one another and supported by a pair of dynode support insulators 26, (only one of which is shown). The insulators 26 may comprise a material such as ceramic which may be machined and has high mechanical strength.

A metallic wall coating 28, which may, for example, be a relatively thin film of aluminum, is disposed on the inner surface of the tube envelope 10 and contacts the photocathode 16. The metallic coating 28 extends from the photocathode axially down the tube wall and thus forms a cylindrical electrode coaxial with the field forming electrode 18.

A novel electron multiplier 30 comprises an arcuately-shaped dynode 32, a plurality of secondary dynodes 34–52 and 56, and an anode 54. The secondary dynodes and the anode are laterally displaced from the primary dynode 32 and attached between the dynode support insulators 26. The secondary dynodes are serially disposed in two substantially parallel columns. Dynodes 36,40, 44, 48 and 52 are disposed in a first column adjacent to the primary dynode 32. Each of the dynodes of the first column are substantially J-shaped and identical in shape to one another. The dynodes 34, 38, 42, 46, 50 and 56 are disposed in a second column, remote from the primary dynode 32. Each of the dynodes 34, 38, 42, 46 and 50 of the second column are substantially identical to one another and are shaped as mirror images of the dynodes of the first column. The final dynode 56 is substantially L-shaped and is disposed adjacent to the anode 54. Dynode 34 of the second column of dynodes is the input secondary dynode and is positioned to receive secondary electrons from the primary dynode 32. The dynodes 32–52 and 56 may be made of any conventional material having a high secondary emission, such as, for example, beryllium-copper alloy.

An electron permeable member 60 is disposed between the photocathode 16 and the first dynode 32 in close proximity to the first dynode 32. The electron permeable member 60 also extends between the primary dynode 32 and the input secondary dynode 34. In the preferred embodiment, the electron permeable member 60 is spaced from and substantially parallel to the primary dynode 32. The electron permeable member 60 is preferably a mesh electrode having a plurality of apertures therethrough. The mesh member 60 should have an electron transmission of about 90 to 95 percent or more and may be formed by a method well known in the art. The member 60 serves to shield the primary dynode 32 from the electrostatic fields produced by the surrounding electrodes while providing an accelerating field for secondary electrons leaving the primary dynode 32 for the input secondary dynode 34.

Figure 3:
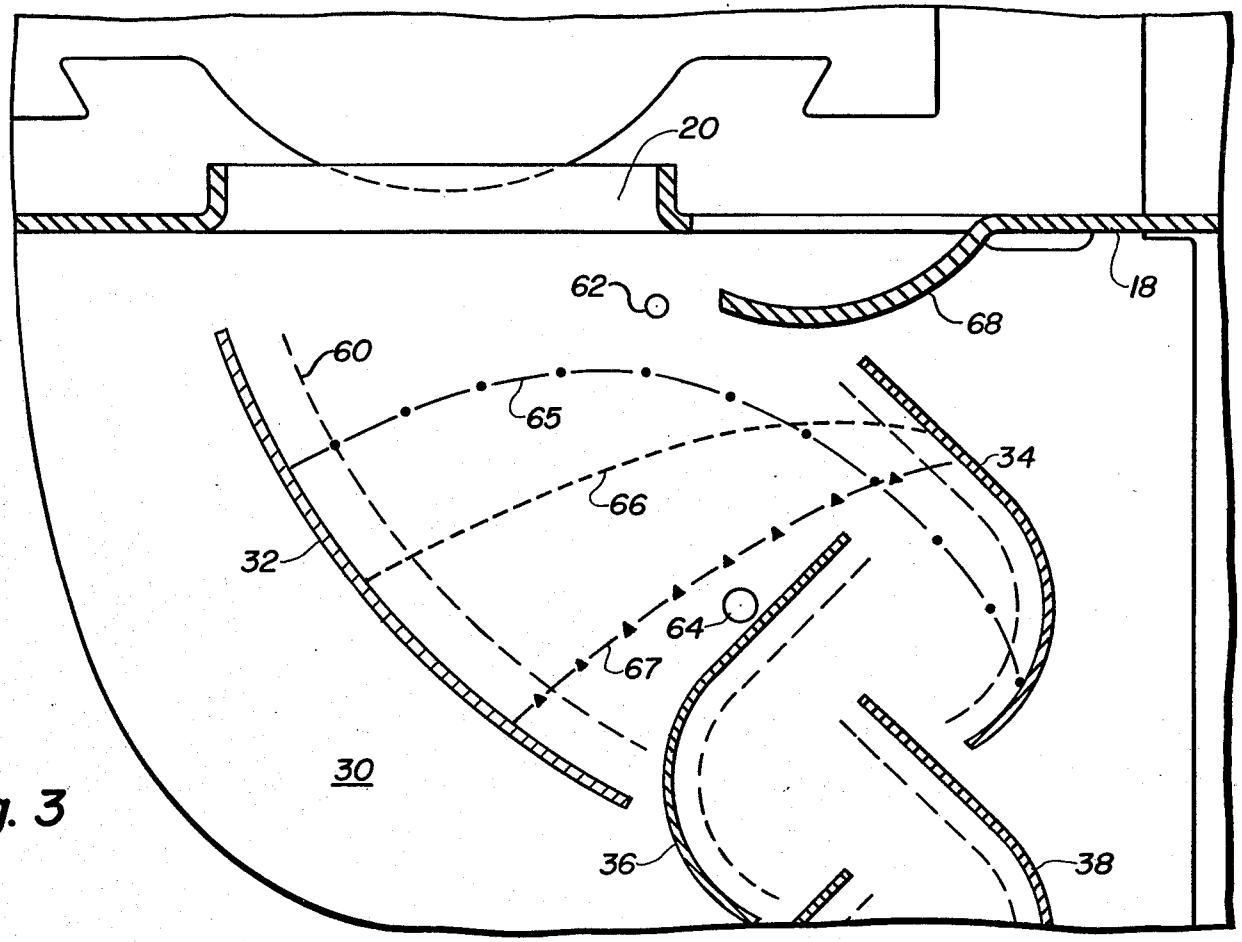
FIG. 3 is an enlarged view of a portion of the novel electron multiplier structure shown in FIG. 1.

As shown in FIG. 3, a pair of steering electrodes 62 and 64 are disposed between the electron permeable member 60 and the input secondary dynode 34 to direct the secondary electrons from the primary dynode 32 to the input secondary dynode 34. Three electron paths 65, 66 and 67 are shown. An arcuate projection 68, formed from the base portion of the field forming electrode 18, extends into the space between steering electrode 62 and the input secondary dynode 34 and assists in directing the secondary electrons onto the surface of the dynode 34.

As shown in FIG. 1, a plurality of optional electron permeable second members 74–92 may be disposed in spaced, parallel relation to each of the secondary dynodes 34–52, respectively. The electron permeable second members screen the surfaces of the secondary dynodes from the electrostatic fields of adjacent electrodes and provide a uniform accelerating field for secondary electrons emitted from the surface of the secondary dynodes 34–52.

In the operation of the photomultiplier tube, shown in FIG. 1, electrical leads (not shown) extend between pins 94 in a base 96 and the above-described tube electrodes and dynodes for applying potentials thereto. Typical approximate operating potentials are shown in the following chart:

| | |
|---|---|
| Cathode 16 | −1500 volts DC |
| Electrode 18 | −1200 volts DC |
| Electrode 22 | −1500 volts DC |
| Dynode 32 | −1200 volts DC |
| Member 60 | −1150 volts DC |
| Dynode 34 | −1100 volts DC |
| Steering Electrode 62 | −1250 volts DC |
| Steering Electrode 64 | −800 volts DC |
| Dynode 36 | −1000 volts DC |
| Dynode 38 | −900 volts DC |
| Dynode 40 | −800 volts DC |
| Dynode 42 | −700 volts DC |
| Dynode 44 | −600 volts DC |
| Dynode 46 | −500 volts DC |
| Dynode 48 | −400 volts DC |
| Dynode 50 | −300 volts DC |
| Dynode 52 | −200 volts DC |
| Dynode 56 | −100 volts DC |
| Anode 54 | Ground |

In a tube structure where the optional electron permeable second members 74–92 are used, the potential applied to the second members is midway between the potential of the adjacent dynode and next succeeding dynode. For example, the potential on electron permeable second member 74 is equal to the average of the potential on dynodes 34 and 36. The electron permeable second members 74–92 should have an electron transmission of about 90 to 95 percent or more.

THEORY OF OPERATION

With the tube suitably energized as described above, radiation incident on the photocathode 16 releases photoelectrons (not shown) which are focused by the fields generated by elements 18, 22 and 28. The photoelectrons from the cathode 16 pass through the aperture 20 in the field forming electrode 18 and pass as primary electrons through the electron permeable member 60 and impinge upon the primary dynode 32. Secondary electrons generated by the primary photoelectrons are uniformly accelerated by the field produced by the electron permeable member 60. The secondary electrons represented schematically by beams 65, 66 and 67 pass through the permeable member 60 in a direction substantially opposite to the direction of the incoming photoelectrons. The secondary electron beams 65, 66 and 67 are directed by steering electrodes 62 and 64 to impinge on the surface of the input secondary dynode 34. Secondary electrons emitted from secondary dynode 34 are propagated and concatenated through the remaining secondary dynodes 36–52 and 56 to the anode 54.

GENERAL CONSIDERATION

Figure 2:
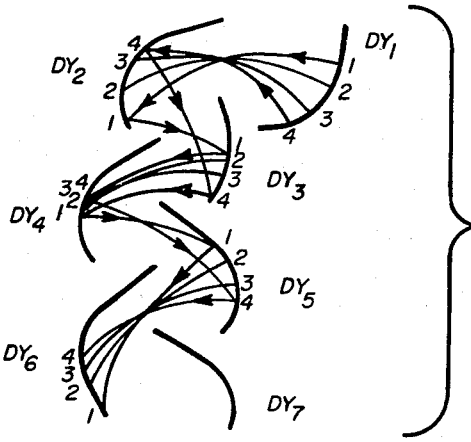
Prior Art Fig. 2
FIG. 2 is a schematic view of a prior art compensated design electron multiplier.

The novel electron multiplier 30 described above improves electron transit time through the multiplier by using an electron permeable member 60 adjacent to the primary dynode 32 to reduce the space charge surrounding the dynode 32 and to accelerate the secondary electron beams, with the assistance of steering electrons 62 and 64, onto the input secondary dynode 34. The electron permeable second members 74–92 which operate at potentials midway between the adjacent and the next successive dynode in the dynode chain provide an accelerating potential without the extraneous noise of high voltage accelerating electrodes. Only two basic J-shapes are required to form the secondary dynodes 34–52, whereas the compensated design multiplier shown in FIG. 2 requires a greater plurality of different dynode shapes.

What is claimed is:

1. An electron discharge device of the type having a source of primary electrons, an anode and an electron multiplier disposed between said source of electrons and said anode, said electron multiplier comprising:

a primary dynode having a secondary emissive surface for propagating secondary electrons therefrom in response to primary electrons from said source impinging thereon, at least one secondary dynode spaced from said primary dynode for continuing the propagation of said secondary electrons toward said anode, an electron permeable member disposed between said source and said primary dynode and extending between said primary dynode and said secondary dynode, and steering means disposed between said electron permeable member and said secondary dynode for directing said secondary electrons from said primary dynode toward said secondary dynode.

2. A photomultiplier tube of the type having an evacuated envelope, a photoemissive cathode within said envelope for emitting photoelectrons therefrom in response to radiation incident thereon, an anode spaced from said cathode, an electron multiplier disposed between said cathode and said anode, said electron multiplier comprising:

a primary dynode having a secondary emissive surface for propagating secondary electrons therefrom in response to photoelectrons from said cathode impinging thereon, a plurality of secondary dynodes laterally displaced from said primary dynode for concatenating secondary electron emission from said primary dynode to said anode, an electron permeable first member disposed between said cathode and said primary dynode and extending between said primary dynode and said secondary dynodes, and steering means disposed between said electron permeable first member and said secondary dynodes for directing said secondary electron emission from said primary dynode toward said secondary dynodes.

3. A tube as in claim 2 wherein said electron permeable first member is traversed in substantially opposite directions by said photoelectrons from said cathode and by said secondary electron emission from said primary dynode.

4. A tube as in claim 3 wherein said electron permeable first member is substantially parallel to said primary dynode.

5. A tube as in claim 2 further including a plurality of electron permeable second members, each of said members being spaced from and substantially parallel to a different one of said second dynodes.

6. A tube as in claim 5 wherein said electron permeable first and second members comprise mesh electrodes having a plurality of apertures therethrough.

7. A photomultiplier tube of the type having an evacuated envelope, a photoemissive cathode within said envelope for emitting photoelectrons therefrom in response to radiation incident thereon, an anode spaced from said cathode, a primary dynode disposed between said cathode and said anode for propagating secondary electrons therefrom in response to photoelectrons from said cathode impinging thereon, a plurality of secondary dynodes laterally displaced from said primary dynode, said secondary dynodes being serially disposed in two substantially parallel columns, one of said columns being adjacent to said primary dynode, the other of said columns being remote from said primary dynode, said secondary dynodes of said columns being arranged in staggered relation for propagating and concatenating said secondary electrons between said primary dynode and said anode, said remote column having an input secondary dynode for receiving said secondary electrons from said primary dynode, an electron permeable member disposed between said cathode and said primary dynode and extending between said primary dynode and said secondary dynodes for accelerating said secondary electrons from said primary dynode toward said input secondary dynode, said permeable member being substantially parallel to and spaced from said primary dynode, and steering means disposed between said electron permeable member and said secondary dynodes for directing said secondary electrons toward said input secondary dynode.

* * * * *